US006304220B1

(12) United States Patent
Herve et al.

(10) Patent No.: US 6,304,220 B1
(45) Date of Patent: Oct. 16, 2001

(54) ANTENNA WITH STACKED RESONANT STRUCTURES AND A MULTI-FREQUENCY RADIOCOMMUNICATIONS SYSTEM INCLUDING IT

(75) Inventors: Pascal Herve, Paris; Charles Ngounou Kouam, Les Ulis; Jean-Philippe Coupez, Brest, all of (FR)

(73) Assignee: Alcatel, Paris (FR)

( * ) Notice: Subject to any disclaimer, the term of this patent is extended or adjusted under 35 U.S.C. 154(b) by 0 days.

(21) Appl. No.: 09/632,613

(22) Filed: Aug. 4, 2000

(30) Foreign Application Priority Data

Aug. 5, 1999 (FR) ..... 99 10180

(51) Int. Cl.[7] ..... H01Q 1/38
(52) U.S. Cl. ..... 343/700 MS; 343/767
(58) Field of Search ..... 343/700 MS, 702, 343/767, 768, 770, 705, 708, 846; H01Q 1/38

(56) References Cited

U.S. PATENT DOCUMENTS

| | | | | |
|---|---|---|---|---|
| 4,070,676 | | 1/1978 | Sanford . | |
| 4,929,959 | * | 5/1990 | Sorbello et al. | 343/700 MS |
| 5,075,691 | | 12/1991 | Garay et al. . | |
| 5,241,321 | * | 8/1993 | Tsao | 343/700 MS |
| 5,534,877 | * | 7/1996 | Sorbello et al. | 343/700 MS |
| 6,002,367 | * | 12/1999 | Engblom et al. | 343/700 MS |
| 6,008,764 | * | 12/1999 | Ollikainen et al. | 343/700 MS |
| 6,018,320 | * | 1/2000 | Jidhage et al. | 343/700 MS |

FOREIGN PATENT DOCUMENTS

| | | |
|---|---|---|
| 0 795 926 A3 | 9/1997 | (EP) . |
| 0 871 238 A2 | 10/1998 | (EP) . |
| 0 924 797 A1 | 6/1999 | (EP) . |

OTHER PUBLICATIONS

Ormiston, T. D. et al.: "Microstrip Short–Circuit Patch Design Equations" Microwave and Optical Technology Letters, US, John Wiley, New York, vol. 16, No. 1, Sep. 1, 1997, pp. 12–14, XP000198277.

* cited by examiner

*Primary Examiner*—Tho Phan
(74) *Attorney, Agent, or Firm*—Sughrue, Mion, Zinn, Macpeak & Seas, PLLC

(57) ABSTRACT

An antenna with stacked resonant structures includes: a guide line for guiding electromagnetic waves formed in a conductive layer lying in a plane, and two resonant structures having different resonant frequencies, the two structures being formed on respective opposite sides of the plane so that both are coupled directly to the line and substantially decoupled from one another by the conductive layer. The guide line is preferably of the coplanar type and the two resonant structure are preferably of the quarter-wave type. The invention applies in particular to dual-band mobile telephones.

14 Claims, 2 Drawing Sheets

ANTENNA WITH STACKED RESONANT STRUCTURES AND A MULTI-FREQUENCY RADIOCOMMUNICATIONS SYSTEM INCLUDING IT

The invention relates to radiocommunications. It relates more particularly to radiocommunications system antennas, and even more particularly to planar antennas. Planar antennas are included in various types of equipment, such as mobile telephones, mobile telephone base stations, automobiles, aircraft, and missiles. In the case of mobile telephones, the continuous ground plane of the antenna provides an easy way to limit the level of radiation intercepted by the body of the user of the equipment. In the case of automobiles, and above all in the case of aircraft and missiles, whose outside surface is made of metal and has a curved profile to limit aerodynamic drag, a planar antenna can be conformed to that profile so as not to cause unwanted additional aerodynamic drag.

BACKGROUND OF THE INVENTION

In such applications the antenna must be compact but it is nevertheless often required to be able to use several operating frequencies in the radio and microwave frequency bands. The frequencies can be close together and one is used to transmit and another to receive, for example. It is possible to use two frequencies because the antenna bandwidth includes both of the frequencies and all the frequencies between them. The antenna is nevertheless often required to operate in two separate bands, especially in mobile telephones. The ratio between the center frequencies of the two bands is equal to 2 in the particular case of dual-band communications systems, such as those used in the prior art GSM 900 and GSM 1800 systems, with bands at around 900 MHz and 1800 MHz.

The antennas to which the invention relates are in particular of a type referred to hereinafter as "microstrip patch antennas", in other words they have a microstrip structure in which the electric field of a traveling wave is established in a dielectric substrate between a conductive layer referred to as the "ground plane" and another conductive layer referred to as the "patch".

The operating frequencies of an antenna of the above kind are defined by one or more resonant structures included in the antenna. Broadly speaking, two basic types of resonant structure can be fabricated using the microstrip technique. A first type of structure is referred to as the "half-wave" structure. If one dimension of the patch is referred to as its length and extends in a direction referred to as the longitudinal direction, the length is substantially equal to half the wavelength of an electromagnetic wave propagating in that direction in the line consisting of the ground plane, the substrate and the patch. Coupling to radiated waves occurs at the ends of the length, which are in regions where the amplitude of the electric field in the substrate is at a maximum.

A second type of resonant structure that can be fabricated using the same technique is referred to as a "quarter-wave" structure. It differs from a half-wave structure firstly in that the length of its patch is substantially equal to one-fourth of the wavelength, the length of the patch and the wavelength being defined as above, and secondly in that a clear short-circuit is provided between the ground plane and the patch at one end of the length of the patch to impose a quarter-wave resonance with one electric field node fixed by the short-circuit. Coupling with radiated waves occurs at the other end of the length, which is in a region where the amplitude of the electric field through the substrate is at a maximum.

In practice various types of resonance can be established in such antennas, and depend in particular on:

- the configuration of the patches, which in particular can incorporate slots, possibly radiating slots,
- the presence and location of short-circuits, and the electrical models representative of such short-circuits, which cannot always be treated, even approximately, as perfect short-circuits with zero impedance, and
- coupling systems included in the antennas to enable their resonant structures to be coupled to a signal processor unit such as a transmitter, and the location of such systems.

What is more, there can be a plurality of resonance modes for a given antenna configuration, and this enables use of the antenna at a plurality of frequencies corresponding to the resonance modes.

The invention relates more particularly to antennas referred to as "stacked" antennas in which a plurality of resonant structures are combined within the same antenna by stacking them. They then occupy different volumes.

Two antennas including, from the bottom upwards, a stack comprising a conductive ground plane, a bottom dielectric layer, a conductive layer referred to as the "coupling layer", a top dielectric layer and a top conductive layer are known in the art.

The first antenna is described in the article "Broadband stacked shorted patch", R. B. Waterhouse, Electronics Letters, Jan. 21, 1999, Vol. 35, No. 2, pp. 98, 99. It includes short-circuit conductors which greatly limit the length of each of the two stacked resonant structures.

The second antenna is described in the article "Thin dual-resonant stacked shorted patch antenna for mobile communications", J. Ollikainen, M. Fisher and P. Vainikainen, Electronics Letters, Mar. 18, 1999, Vol. 35, No. 6, pp. 437, 438. Each of its two resonant structures is of the quarter-wave type.

Each of the above two prior art antennas is fed, in other words coupled to a signal processor unit such as a transmitter or a receiver, via a coaxial line whose ground conductor and axial conductor are respectively connected to the ground plane and to the coupling layer of the antenna. Choosing the position of the point of connection between the axial conductor and the coupling layer is critical and leads to a high fabrication cost. What is more, despite the presence of two partly separate resonant structures, it appears that coupling is required between the two structures and it is not apparent that such coupling enables the structures to operate in two bands that are as far apart as is often required. In particular, it is not apparent that the ratio of the center frequencies of the two bands can easily be as high as 2.

A third prior art antenna is described in the article "Broadband CPW fed stacked patch antenna", W. S. T. Rowe and R. B. Waterhouse, Electronics Letters, Apr. 29, 1999, Vol. 35, No. 9, pp. 681–682. It includes in particular, from the bottom upwards, a ground plane including a coplanar feed line, a dielectric line, a dielectric layer, a patch, two dielectric layers, a patch and a dielectric layer. These layers form two stacked resonant structures. As in the first and second prior art antennas, coupling appears to be required between the two structures and opposes operation in two bands that are as far apart as is desirable.

Unlike the preceding structures, the resonant structures of a fourth prior art antenna are not of the patch type. The fourth antenna is described in the article "Stacked Dielectric Antenna for Multifrequency Operation", A. Sangiovanni, J. Y. Dauvignac, Ch. Pichot, Microwave & Optical Technology Letters, Vol. 18, No. 4, July 1998, pp. 303–306. It associates three resonant structures which are of a type referred to as the "dielectric type", meaning that each consists of a dielectric block with appropriate permittivity and dimensions. The overall size of the fourth prior art antenna would not appear to be as small as is often required.

OBJECTS AND SUMMARY OF THE INVENTION

The objects of the present invention, which is directed to the production of an electromagnetic antenna, are:

a small overall size, a sufficiently large bandwidth, two separate bands, a high ratio between the center frequencies of the two bands, in particular a ratio close to 2, and in particular the facility to adjust each of the two center frequencies without significantly affecting the other one, and a low cost of fabrication.

With the above objects in view, the invention provides in particular an antenna with stacked resonant structures, the antenna including:

two resonant structures facing each other on respective opposite sides of a plane occupied by a conductive layer constituting a coupling layer, the two structures having respective resonant frequencies with a defined frequency ratio, and an internal coupling system including at least one slot formed in the coupling layer to enable coupling of the two resonant structures to a processor unit external to the antenna, in which antenna said two resonant structures are sufficiently decoupled from one another by said coupling layer for the coupling of each of the two structures to said processor unit via said internal coupling system to be substantially independent of the other of the two structures, said frequency ratio departing significantly from a value imposed on that ratio by coupling between the two structures.

The mutual coupling or decoupling of the two resonant structures influences the possible values of the ratio of the effective resonant frequencies of the two structures. The effect of the decoupling in accordance with the invention is that a wanted resonant frequency of each structure is determined in practice by the geometrical and electromagnetic characteristics of that structure alone, and that the frequency concerned can therefore be chosen relatively freely by an appropriate choice of those characteristics. The ratio between the effective resonant frequencies of the two structures can then be chosen freely. In contrast, in prior art stacked resonant structure antennas, a high level of coupling appears to be required between the two structures to enable one structure to be coupled to the external processor unit via the other structure, which has been the only one considered until now to be usefully coupled to that unit. The high level of coupling imposed a limit on the ratio of the resonant frequencies of the structures.

According to the invention, the ratio of the resonant frequencies of the two resonant structures departs significantly from values which, from the point of view of the functioning of the antenna, would in practice be compatible with a high level of coupling between the structures.

In the situation described above, in which the two resonant structures are of the same type, such as the quarter-wave type, the ratio of the two frequencies departs farther from unity than in prior art antennas. It is greater than 1.5, for example. If one of the structures is of the quarter-wave type and the other of the half-wave type, the ratio of the two frequencies can likewise depart from 2 by more than in the prior art antennas. It can be greater than 3, for example. In both cases the ratio between the two values of the frequency ratio, one value resulting from the use of the invention and the other resulting from a high level of coupling between the two resonant structures, can be equal to 1.5. It can advantageously attain higher values, such as values of 2 and above.

The internal coupling system is preferably a coplanar line. In a coplanar line the electric field of a traveling wave is established symmetrically between a central conductive strip and two conductive lands on respective opposite sides of the strip, from which they are separated from respective slots. The strip and the lands are in the same plane. The invention exploits, if not the symmetry in this plane with respect to the axis of the strip, at least the fact that the coupling possibilities from a line of this kind formed in a plane are the same on either side of that plane. Thus if, in accordance with the invention, two resonant structures are formed on respective sides of the plane, effective coupling can easily be obtained between the line and each of the structures, without this wanted coupling being accompanied by a high level of unwanted coupling between the two structures.

Alternatively, the internal coupling system could take the form of a single slot line or any other line consisting of slots formed in a conductive layer and adapted to guide a traveling wave.

BRIEF DESCRIPTION OF THE DRAWINGS

How the invention can be put into practice is described below with the assistance of the accompanying diagrammatic drawings.

MORE DETAILED DESCRIPTION

Figure 1:
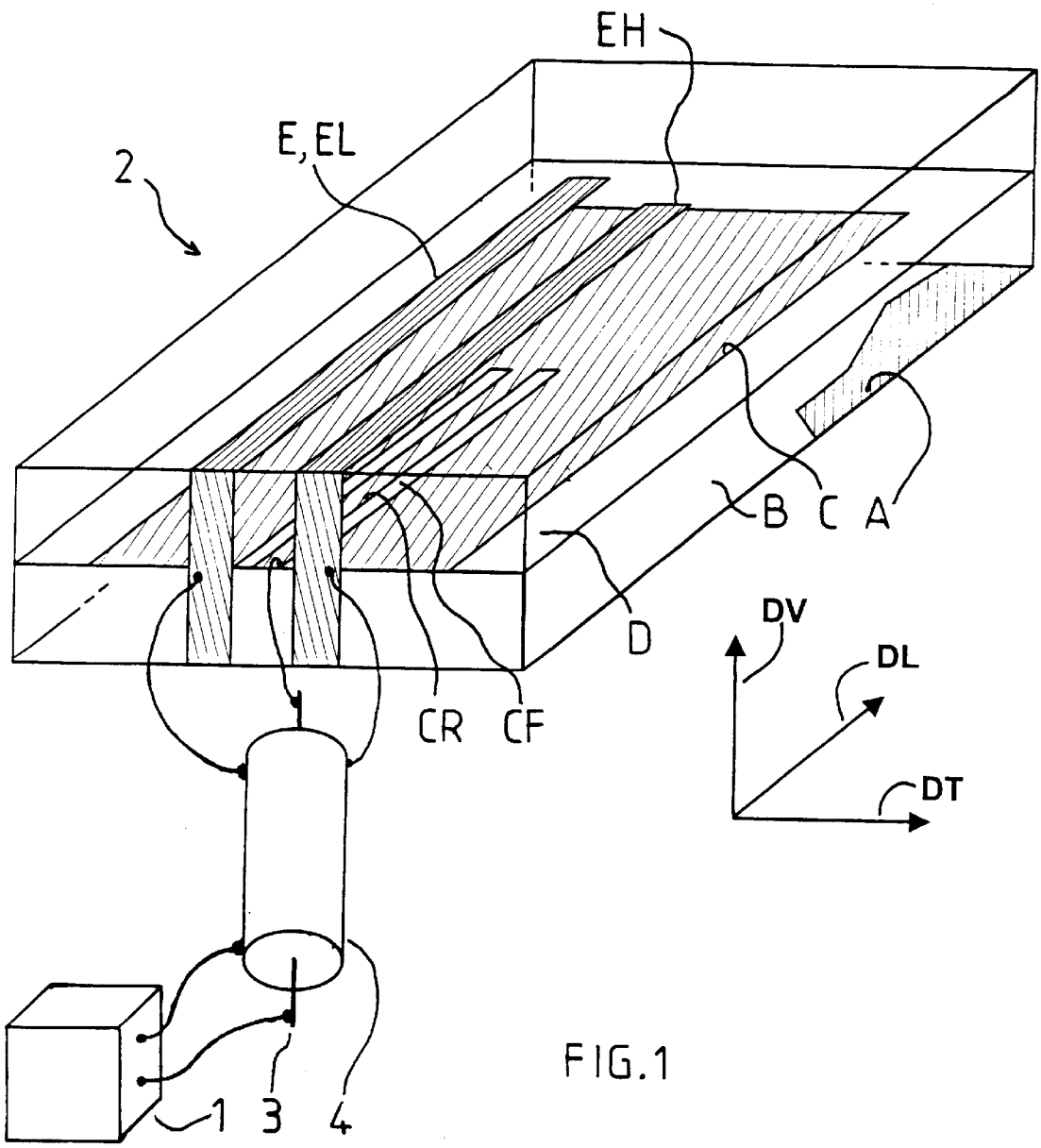
FIG. 1 is a perspective view of a radiocommunications system including an antenna constituting one example of the invention.

In the figures, thin metal layers on the surface of dielectric layers are shaded. In FIG. 1, to simplify the drawing, the dielectric layers are represented as if they were transparent, in order to show the underlying layers, and the shading representing the bottom conductive layer is limited to part of that layer.

Figure 2:
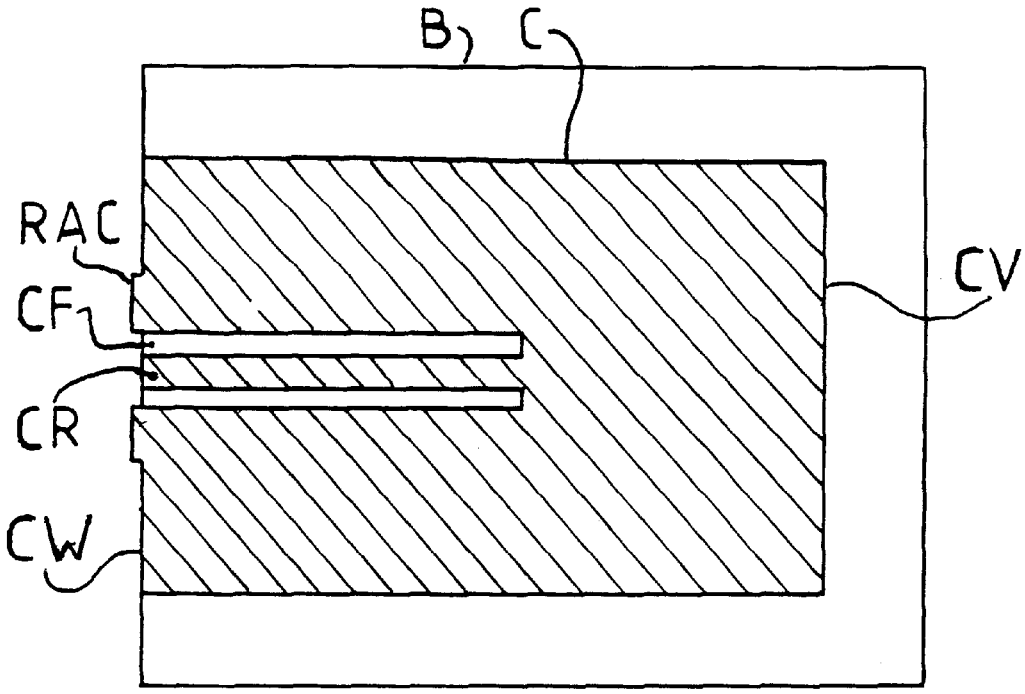
FIG. 2 is a top view of the same antenna after removing the top two layers to expose a coupling layer.
Figure 3:
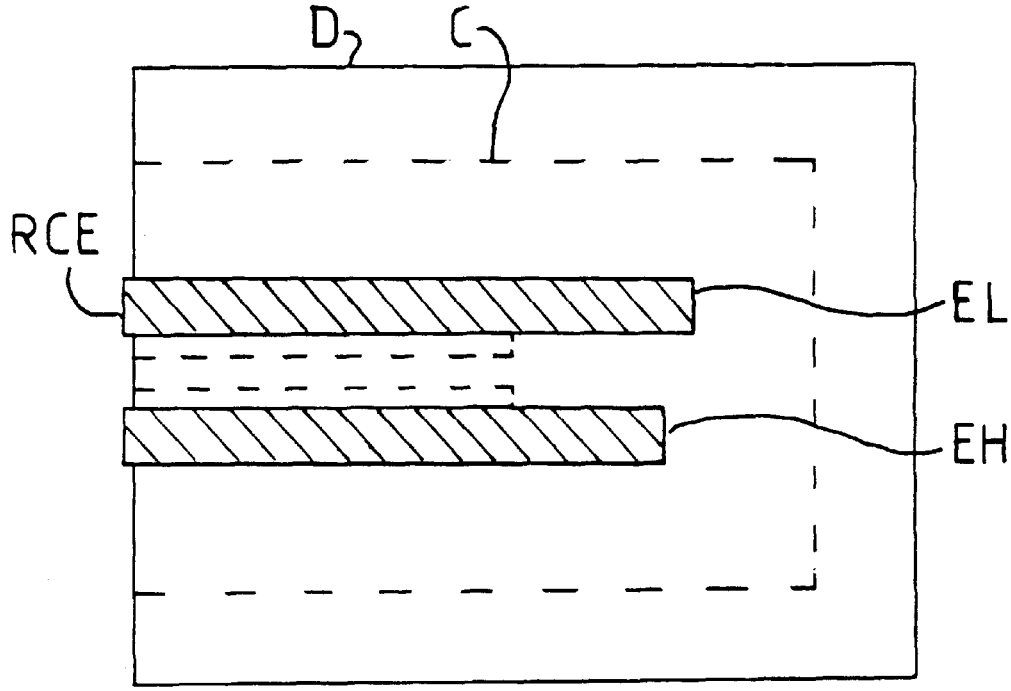
FIG. 3 is a top view of the same antenna.

Referring to FIG. 1, three mutually crossing axes respectively constitute a longitudinal axis DL, a transverse axis DT and a vertical axis DV of an antenna and the longitudinal and transverse axes are horizontal axes. The above terminology is employed to facilitate the description and is without regard to the direction of the gravitational field. The longitudinal axis has a forward direction, which is that of the arrow DL, and a retrograde direction opposite the forward direction. The antenna includes a plurality of layers A, B, C, D, E, forming a succession in the vertical direction. Each layer, such as the layer C, has an area extending in said direction DL of the longitudinal axis from a rear edge, for example the edge CW (see FIG. 2), to a front edge of that layer, for example the edge CV, and this area also extends in the direction of the transverse axis DT. It also has a thickness in the direction of the vertical axis DV. At least one of the layers is a conductive layer and constitutes a coupling layer C. Two other layers are dielectric layers and constitute a bottom dielectric layer B and a top dielectric layer D respectively below and above the coupling layer.

The layers A, B and C form a bottom resonant structure ABC and the layers C, D and E form a top resonant structure CDE. Each structure enables traveling electromagnetic waves to propagate in both directions along the longitudinal axis. The waves are reflected in the structure to form at least one standing wave whose frequency is a resonant frequency of the structure which defined by the electrical length of the structure and by a propagation speed for traveling waves inherent to and defined by the structure. The standing wave exchanges energy with waves radiated in the space external to the antenna. The resonant frequencies of the resonant structures referred to here are average frequencies of operating bands of the structures which are defined in the usual manner in the antenna art.

The antenna also includes an internal coupling system adapted to guide traveling waves exchanging energy with respective standing waves formed in the bottom and top resonant structures. Electromagnetic energy can therefore be exchanged between said external space and the coupling system through each of the two resonant structures and at the frequency of that structure.

According to the invention, the coupling layer C includes two slots extending substantially along the longitudinal axis DL from the rear edge CW of this layer. The slots constitute coupling slots, for example the slots CF. They delimit in the coupling layer a coupling strip CR which is connected to a main part of the coupling layer within the area of the layer. It co-operates with the slots and with the main part to form a coupling line CF, CR which constitutes the coplanar line and the internal coupling system previously mentioned.

In a radiocommunications system, the above antenna is connected to a signal processor unit 1 such as a transmitter if the antenna is transmitting or a receiver if the antenna is receiving. To this end it has two terminals which receive energy from a transmitter or supply energy to a receiver. The two terminals are typically on the rear edge CW of the coupling layer and one consists of the coupling strip and the other consists of the parts of the coupling layer beyond the coupling slots. The impedance of the antenna, to which the processor unit must be matched, can be measured between these two terminals.

Each of the resonant structures could consist only of one or more dielectric layers, like those of dielectric antennas. However, in the context of the invention, the antenna preferably further includes at least one external conductor, for example the layers A and E, and one of the two dielectric layers, for example one of the layers B and D, is disposed between the external conductive layer and the coupling layer C. The external conductive layer co-operates with the dielectric layer and with the coupling layer to constitute one of the two resonant structures. Either the external conductive layer or the coupling layer, for example the layer C or the layer E, has horizontal dimensions, or at least a longitudinal dimension, smaller than a conductive structure consisting of the other layer, for example the layer A, or including the second layer, for example the layer C, which could form a conductive structure of this kind with the layer C. The first layer and the conductive structure respectively constitute a patch and a ground plane of the structure and the resonant frequency of the structure is essentially dependent on an electrical length of the patch and independent of the longitudinal dimensions of the ground plane.

The radiated waves transmitted or received by a patch resonant structure of the above kind can propagate in the vicinity of the antenna only in the half of the space which is on the same side of the ground plane of the structure as the patch.

In the embodiment of the invention described below, the two resonant structures are of the patch type, i.e. the antenna includes two external conductive layers, namely a bottom conductive layer A under the bottom dielectric layer B which forms the bottom resonant structure ABC and a top conductive layer E on top of the top dielectric layer D which forms the top resonant structure CDE.

The two resonant structures could have the same ground plane, which would then be entirely common to them and would consist of the coupling layer C, whose longitudinal and transverse dimensions would therefore be made larger than those of each of the patches of the structures. As a result, radiated waves transmitted or received by the two structures could propagate in the vicinity of the antenna only in two halves of the space on respective opposite sides of the ground plane. This would be a problem in most of the intended applications, because these applications require electromagnetic energy to be exchanged at several different frequencies with the same half of the space.

This is why, in the context of the invention, the bottom conductive layer A preferably has sufficiently large horizontal dimensions to constitute the ground plane of at least the bottom resonant structure ABC. The coupling layer C then constitutes both the patch of that structure and at least an inside part of the ground plane of the top resonant structure CDE, whose patch consists of the top conductive layer E.

In the embodiment of the invention described below, the coupling layer has sufficiently large horizontal dimensions to constitute the ground plane of the top resonant structure. However, it could also have dimensions too small for this, in which case a peripheral part of the ground plane would consist of the bottom conductive layer and a peripheral part of the bottom dielectric layer would be part of the top resonant structure.

Each of the patch resonant structures can have resonances of various types, for example the half-wave type and the quarter-wave type. However, in the context of the invention, the antenna preferably further includes at least one short-circuit conductor, for example the conductor RAC, specific to at least one of the two resonant structures, for example the structure ABC. A connector of this kind connects the rear edge, for example the edge CW, of the patch C of the structure to the ground plane A of the structure, so that the structure has a quarter-wave resonance. It joins the rear edge CW of the coupling layer outside a coupling segment SC which is part of that edge and includes the coupling strip CR and the coupling slots CF. It enables the length of the antenna to be limited by the use of a quarter-wave resonance and its position on the rear edge CW prevents it interfering with the operation of the internal coupling system.

In the preferred situation in which at least the bottom resonant structure ABC is of the quarter-wave type and in which the short-circuit conductor therefore connects the coupling layer C to the bottom conductive layer A, a microstrip line appears to be constituted by the coupling strip CR which co-operates with a ground plane via the bottom dielectric layer B, the ground plane consisting of the layer A. What is more, the line appears to be disposed in such a manner that it can feed the antenna if it is transmitting. In the context of the invention, the antenna is then nevertheless essentially fed by the coplanar line formed by the co-operation of the strip CR with the remainder of the coupling layer via the coupling slots. The thickness of the layer B is made sufficiently large and its permittivity is made sufficiently low to allow this. This choice means in particular that the impedance of the antenna is at least closer to that of the coplanar line than that of the microstrip line.

Each quarter-wave structure, for example the structure ABC, is preferably provided with two short-circuit conductors, for example the conductors RAC, which meet said rear edge CW of the coupling layer C on respective opposite sides of said coupling segment SC.

In the embodiment of the invention described by way of example, the bottom resonant structure ABC and the top resonant structure CDE are of the quarter-wave type. Implementing the two stacked short-circuit conductors, for example the conductors RAC and RCE, forming parts of the respective structures is then facilitated by the fact that the two conductors consist of two strips which are continuous with each other. The two conductors on each side of the coupling segment SC are then made collectively in the form of a short-circuit strip extending the full height of a rear vertical transverse edge of a rectangular plate formed by all the stacked layers of the antenna. The thickness of this plate is essentially made up of those of the dielectric layers B and D, the lengths and widths of the two layers being the same and the thickness of each of them being uniform within its area.

In this embodiment, the propagation speed in the top resonant structure CDE is advantageously greater than 150% of the propagation speed in the bottom resonant structure BC and the resonant frequency of the top resonant structure is greater than 150% of the resonant frequency of the bottom resonant structure. These propagation speeds are average speeds of longitudinal propagation in these structures of electromagnetic waves having a frequency of 1 GHz.

In the theoretical situation in which the dielectric layer of a structure of this kind has a uniform thickness and composition, which is practicable, its patch and its ground plane consist of metal layers of negligible electrical resistance and the ground plane is very wide, the propagation speed of waves in the structure would be a function of the width w of the patch, the thickness h of the dielectric layer and its relative permittivity r. This function is given in particular in the book "Transmission Line Design Handbook", Brian C. Wadell, Artech House, Boston, London. The propagation speed is a physical characteristic of the structure.

The resonant frequency of a structure of the above kind is proportional to its inherent propagation speed divided by an electrical length of the structure. This is why two arrangements have appeared to be desirable, in a practical case, in order to limit the overall size, given the substrates available for the dielectric layers B and D. In one arrangement, the patch of the top resonant structure has an electrical length slightly less than that of the patch of the bottom resonant structure so that, allowing for the ratio between the propagation speeds in the two structures, the resonant frequency of the top structure is close to twice that of the bottom structure. In the second arrangement, the required ratio of the propagation speeds in the two structures is obtained by choosing the permittivities of the substrates, which are the same thickness.

In the embodiment described by way of example, the patch E of the top resonant structure CDE advantageously takes the form of two resonant strips EL and EH respectively connected to two short-circuit strips, for example the strip RCE, and extend longitudinally from the latter on the top dielectric layer D. This enables the use of two metal strips bent to form both the top patch and the short-circuit strips. It also enables the bandwidth of the top resonant structure to be increased because the two coupling strips EL and EH have slightly different lengths. The widths of the two strips are equal and sufficient for each of them to function as an individual patch, i.e. two resonances occur whose center frequencies are inversely proportional to the lengths of the two strips and therefore slightly different. The bands corresponding to the two resonances then partly overlap, which increases the bandwidth of the structure including the two strips rather than duplicating it.

Various compositions and values are indicated below for the embodiment described by way of example, and the lengths and widths indicated are in the directions of the axes DL and DT, respectively:

- frequency of structure ABC: 900 MHz,
- frequency of structure CDE: 1800 MHz,
- bandwidth of structure ABC: 40 MHz for a standing wave ratio (SWP) not greater than 2,
- bandwidth of structure CDE: 80 MHz for a standing wave ratio (SWP) not greater than 2,
- antenna input impedance: 50 Ohms,
- characteristics of dielectric layer B: epoxy resin, relative permittivity $\in r=5$, dissipation factor tan $\delta=0.002$, thickness 5 mm,
- composition and thickness of conductive layers: copper, 17 microns,
- length of coupling layer C: 35 mm,
- width of layer C: 30 mm,
- length of coupling line CR, CF: 20 mm,
- width of coupling strip CR: 5 mm,
- width of coupling slots CF: 0.5 mm,
- width of short-circuit strips, e.g. RAC, RCE: 5 mm,
- characteristics of dielectric layer D: epoxy resin, relative permittivity $\in r=3$, dissipation factor tan $\delta=0.002$, thickness 3.2 mm,
- length of resonant strip EL: 35 mm,
- length of resonant strip EH: 34 mm,
- common width of strips EL and EH: 5 mm.

Another antenna according to the invention can have a bottom resonant structure and a coupling line analogous to those described above and is different in that only the bottom resonant structure ABC is of the quarter-wave type. The coupling line (CF, CR) extends from the rear edge CW of the coupling layer C at least into a middle part of the length of the patch E of the top resonant structure CDE, to cause a half-wave type resonance in that structure.

The fact that the top resonant structure has a half-wave type resonance means that its frequency can be twice that of the bottom resonant layer and enables two identical substrates, which therefore have the same thickness and the same permittivity, to be used for the dielectric layers B and D. This facilitates the implementation of an antenna having two frequencies with a ratio between them which is close to 2.

The invention also provides a multifrequency radiocommunications system. As known in the art, that system includes:

- a processor unit 1 adapted to transmit and/or to receive a guided electromagnetic wave that can have two frequencies, and
- an antenna connected to the processor unit to couple the guided wave to radiated waves. In the system, the antenna uses one of the preceding arrangements and said two resonant structures ABC and CDE respectively resonate at said two frequencies of the guided electromagnetic wave.

For example, the connection is made by a coaxial line whose axial conductor 3 is soldered to the coupling strip CR and whose ground conductor 4 is connected to two of the short-circuit strips, for example the strips RAC or the strips RCE.

What is claimed is:

1. An antenna with stacked resonant structures, the antenna including:

two resonant structures facing each other on respective opposite sides of a plane occupied by a conductive layer constituting a coupling layer, the two structures having respective resonant frequencies with a defined frequency ratio, and an internal coupling system including at least one slot formed in the coupling layer to enable coupling of the two resonant structures to a processor unit external to the antenna, in which antenna said two resonant structures are sufficiently decoupled from one another by said coupling layer for the coupling of each of the two structures to said processor unit via said internal coupling system to be substantially independent of the other of the two structures, said frequency ratio departing significantly from a value imposed on that ratio by coupling between the two structures.

2. An antenna according to claim 1, wherein said internal coupling system is a coplanar line constituting a coupling line.

3. An antenna according to claim 2, wherein three mutually crossing axes constitute for the antenna respectively a longitudinal axis, a transverse axis and a vertical axis, the longitudinal and transverse axes constitute horizontal axes, the longitudinal axis has a forward direction and a retrograde direction opposite the forward direction, the antenna includes a plurality of layers forming a succession in the vertical direction, each of said layers having an area extending in said forward direction of the longitudinal axis from a rear edge to a front edge thereof, said area also extending along said transverse axis, each layer also having a thickness along said vertical axis, one of said layers constituting said coupling layer, two other layers comprising dielectric layers constituting a bottom dielectric layer and a top dielectric layer respectively below and above the coupling layer, said resonant structures constituting a bottom resonant structure and a top resonant structure, respectively, including said bottom dielectric layer and said top dielectric layer, wherein each of the structures enables traveling electromagnetic waves to propagate in both directions along the longitudinal axis, which waves are reflected in the structure to form therein at least one standing wave having a resonant frequency of the structure and by a propagation speed of traveling waves inherent to and defined by the structure, the standing wave exchanging energy with radiated waves in the space external to the antenna, said internal coupling system guiding traveling waves exchanging energy with respective standing waves formed in the bottom and top resonant structures so that electromagnetic energy can be exchanged between said external space and the coupling system via each of the resonant structures at the frequency of that structure, said coupling layer including two slots extending substantially along said longitudinal axis from said rear edge of the layer, the slots constituting coupling slots and delimiting in the layer a strip constituting a coupling strip, said strip being connected to a main part of the coupling layer inside said area of the coupling layer, and said strip co-operating with the slots and said main part to form said coupling line constituting the internal coupling system.

4. An antenna according to claim 3, wherein said layers of the antenna further include at least one external conductive layer, one of said two dielectric layers being disposed between the external conductive layer and said coupling layer, said external conductive layer co-operating with the dielectric layer and with the coupling layer to constitute one of said two resonant structures, either the external conductive layer or the coupling layer having horizontal and at least longitudinal dimensions smaller than a conductive structure including the other of those layers, and said external conductive layer and the conductive structure respectively constituting a patch and a ground plane of the structure such that said resonant frequency of the structure is essentially dependent on an electrical length of the patch and independent of said longitudinal dimensions of the ground plane.

5. An antenna according to claim 4, wherein said layers of the antenna include two of said external conductive layers respectively constituting a bottom conductive layer under said bottom dielectric layer to constitute said bottom resonant structure and a top conductive layer on top of said top dielectric layer to constitute said top resonant structure.

6. An antenna according to claim 5, wherein said bottom conductive layer has sufficiently large horizontal dimensions to constitute said ground plane of at least said bottom resonant structure, said coupling layer then constituting both said patch of the structure and at least an internal part of said ground plane of the top resonant structure, and said patch of the top resonant structure consists of said top conductive layer.

7. An antenna according to claim 6, further including at least one short-circuit conductor specific to at least one resonant structure of said two resonant structures, the conductor connecting said rear edge of said patch of the structure to said ground plane of the structure, whereby the structure has a quarter-wave type resonance and constitutes a quarter-wave structure, and the short-circuit conductor meets said rear edge of the coupling layer outside a coupling segment which is part of that edge and includes said coupling strip and said coupling slots.

8. An antenna according to claim 7, wherein each of said quarter-wave structures has two of said short-circuit conductors meeting said rear edge of the coupling layer on respective opposite sides of said coupling segment.

9. An antenna according to claim 8, wherein only said bottom resonant structure constitutes one of said quarter-wave structures and said coupling line extends from said edge of the coupling layer at least into a middle part of the length of said patch of the top resonant structure so as to cause a half-wave type resonance in the structure.

10. An antenna according to claim 8, wherein said bottom resonant structure and said top resonant structure each constitute one of said quarter-wave structures.

11. An antenna according to claim 10, wherein said patch of the top resonant structure takes the form of two resonant strips respectively connected to said two short-circuit strips and extending longitudinally therefrom on said top dielectric layer, and the two resonant strips are of respectively different lengths.

12. An antenna according to claim 10, wherein said propagation speed in the top resonant structure is greater than 150% of said propagation speed in the bottom resonant structure, the resonant frequency of the top resonant structure is 150% greater than the resonant frequency of the bottom resonant structure, and the propagation speeds are average speeds of longitudinal propagation in the structures of electromagnetic waves having a frequency of 1 GHz.

13. An antenna according to claim 12, wherein said two dielectric layers have substantially the same thickness.

14. A multifrequency radiocommunications system including:

a processor unit adapted to transmit and/or to receive a guided electromagnetic wave that can have two frequencies, and an antenna connected to the processor unit to couple the guided wave to radiated waves, in which system said antenna comprises:

two resonant structures facing each other on respective opposite sides of a plane occupied by a conductive layer constituting a coupling layer, the two structures having respective resonant frequencies with a defined frequency ratio, and an internal coupling system including at least one slot formed in the coupling layer to enable coupling of the two resonant structures to said processor unit external to the antenna, in which antenna said two resonant structures are sufficiently decoupled from one another by said coupling layer for the coupling of each of the two structures to said processor unit via said internal coupling system to be substantially independent of the other of the two structures, said frequency ratio departing significantly from a value imposed on that ratio by coupling between the two structures and said two resonant structures respectively resonate at said two frequencies of the guided electromagnetic wave.

* * * * *